US006848126B2

(12) United States Patent
Marcellus

(10) Patent No.: US 6,848,126 B2
(45) Date of Patent: Feb. 1, 2005

(54) WASHING BOWL MOBILE CHAIR

(75) Inventor: Saint-Ange Marcellus, 38 Nelson Dr., Randolph, MA (US) 02368

(73) Assignee: Saint-Ange Marcellus, Randolph, MA (US)

( * ) Notice: Subject to any disclaimer, the term of this patent is extended or adjusted under 35 U.S.C. 154(b) by 40 days.

(21) Appl. No.: 10/446,524

(22) Filed: May 29, 2003

(65) Prior Publication Data

US 2004/0237188 A1 Dec. 2, 2004

(51) Int. Cl.[7] ..... A47K 1/00

(52) U.S. Cl. ..... 4/625; 4/665; 4/664; 4/643; 4/321

(58) Field of Search ..... 4/625–627, 643–646, 4/663–665, 650, 321, 317

(56) References Cited

U.S. PATENT DOCUMENTS

| | | | | | |
|---|---|---|---|---|---|
| 270,459 | A | * | 1/1883 | Milligan | 4/625 |
| 413,200 | A | * | 10/1889 | Milligan | 4/627 |
| 561,026 | A | * | 5/1896 | Parrish | 4/665 |
| 561,514 | A | * | 6/1896 | Lichtenstein | 4/630 |
| 2,058,967 | A | * | 10/1936 | Emmons | 4/665 |
| 2,664,573 | A | * | 1/1954 | Taylor | 4/661 |
| 2,864,094 | A | * | 12/1958 | William, Jr. | 4/661 |
| 2,907,048 | A | * | 10/1959 | Gould | 4/663 |
| 3,594,825 | A | * | 7/1971 | Reid | 4/663 |
| 4,718,131 | A | * | 1/1988 | Kitamura et al. | 4/663 |
| 4,766,622 | A | * | 8/1988 | Pacelli | 4/661 |
| 5,083,580 | A | * | 1/1992 | Lash | 134/113 |

FOREIGN PATENT DOCUMENTS

DE 3911149 C1 * 4/1990

* cited by examiner

*Primary Examiner*—Gregory L. Huson
*Assistant Examiner*—Khoa Huynh

(57) ABSTRACT

A mobile, portable washing bowl or bidet, sink bowl and shower primarily for use indoors. The system uses running water and there is no need for electronic pumps. The entire device is easily transported and meets the personal hygiene needs of people with limited mobility. The washing bowl and sink bowl are mounted to a vertical support riser and washing bowl support plate. The entire frame is mounted to a pneumatic height adjuster assembly, which in turn is mounted to a five-legged caster base. Each leg of the wheelbase terminates with locking casters. There is a water tank which allows water to flow, via gravity, through three sets of flexible hoses to the sink, then the washing bowl and finally through the draining hose. Each hose has a shut off valve so that water can either be contained or released in each of the holding places —the water tank, the sink bowl or the washing bowl.

10 Claims, 4 Drawing Sheets

WASHING BOWL MOBILE CHAIR

BACKGROUND OF INVENTION

This invention relates to a mobile washing chair. It is well known that one of the major problems in attending to patients with reduced mobility, while keeping their dignity intact, is helping them to maintain their personal hygiene. The main issue is that while there are many portable commodes available on the market today for use in hospital or as a home health aid device, none of these devices have running water nor do they address the need of a patient to cleanse themselves. Thus, it would be highly desirable, for caregivers and patients, to have a solution that addresses the need to maintain personal hygiene—personal hygiene, such as washing hands, brushing teeth and rinsing the perineal regions on a human body in a "bidet" like fashion.

Various flushable portable toilets exist in prior art. Most are intended for outside use and are comprised of a cabana like enclosure with a door and roof for complete privacy. Additionally, most of the prior art discloses devices used to receive human waste, and do not address personal hygiene and the ability to wash oneself. Examples of prior art are discussed as follows.

U.S. Pat. No. 5,920,927 issued to Thomas discloses a portable shower and toilet assembly that is designed to be portable and private This device uses a frame, an external water supply to pump water through a shower head, but not through the toilet.

U.S. Pat. No. 5,913,610 issued to Duck in U.S. Pat. No. 5,913,610 discloses a portable flush toilet and enclosure where there are two modes of use, an operating mode and a storage mode. This device has a flushable toilet with a waste tank separated from the toilet bowl. It is designed for use in outdoor venues and its preferred embodiment is to sit inside a cabana.

U.S. Pat. No. 5,704,708 issued to Chandler discloses the use of a water container to allow for water flow through a sink in a portable toilet unit. It is intended to fit into already existing on the marketplace portable toilets.

U.S. Pat. No. 5,500,960 issued to Tagg discloses how to provide fresh water to a portable toilet unit via an external water supply and a pump. This device is intended for outdoor use and its preferred embodiment is in a closed cabana.

U.S. Pat. No. 5,282,281 issued to Clear discloses a portable vacuum toilet that allows water to be added to the toilet bowl during a flush cycle and further discloses an optional water enabled sink. This device is intended for use in a cabana in an outdoor setting and makes use hydrostatic pressure inside a holding sump.

U.S. Pat. No. 6,286,154 issued to Pitts discloses a portable bedside commode. The device is intended for home and indoor use. It is designed with persons of limited mobility in mind and its construction aids such a person in moving from a seated or laying position onto the personal bedside commode using a series of hand rails. This design does not make use of water nor does it comprise a sink.

Although there are portable and flushable toilets in prior art, none of the foregoing patents combine, a sink, a toilet, and the use of water throughout the entire unit in one simple design. Additionally, the above patents are geared towards the outdoor portable toilets that one sees at outdoor venues such as country fairs, public beaches, etc. and are not geared towards use indoors for low mobility who also require the ability to wash themselves and maintain a semblance of personal hygiene.

SUMMARY OF INVENTION

This unique and novel invention, inspired by personal experience with a loved one in a hospital setting, addresses the issue discussed above. It is intended for use in nursing homes, hospitals, in the home, or wherever there is a person with limited mobility.

The basic design of this device is very simple and its very simplicity makes it highly mobile and useful. The device is comprised of a vertical support riser made of some flexible yet strong material such as PVC or injected molded plastic, a washing bowl support plate which is affixed to the vertical support riser, a pneumatic height adjuster assembly and a pneumatic adjuster lever. The entire structure is placed on top of a five-legged wheelbase assembly, and each radial axis of the wheelbase has locking wheels or casters for ease in transporting the device. Attached to the vertical support riser near the top is a refillable water tank. Attached to one side of the vertical support riser, via a hinge, is a curved articulating sink bowl support arm upon which a sink bowl is attached. Affixed to the washing bowl support plate is the actual washing bowl. Attached to the washing bowl support plate are two armrests. Flexible hosing with shut off valves run from the water tank, to the sink, and finally down through the washing bowl where the water and any waste can be emptied when the unit is stored.

A further object of the present invention is to provide a portable, extremely mobile sink bowl and washing bowl assembly that may be quickly and easily moved from one room to another.

Still another object of this invention is to provide a highly mobile washing bowl and sink bowl unit that is of relatively simple construction, is relatively lightweight and durable, and is relatively simple to manufacture.

It is yet another object to provide a water tank so that fresh water is available for washing in the sink bowl and for use in the washing bowl. The tank is easily removable and replaceable and the placement of the water tank does not interfere or encroach upon the space needed for a user of this device.

Other objects, features and advantages of the present invention will become readily apparent from the following description of the invention and its preferred embodiment when considered with the attached drawings and the claims.

DESCRIPTION OF THE INVENTION

Figure 1:
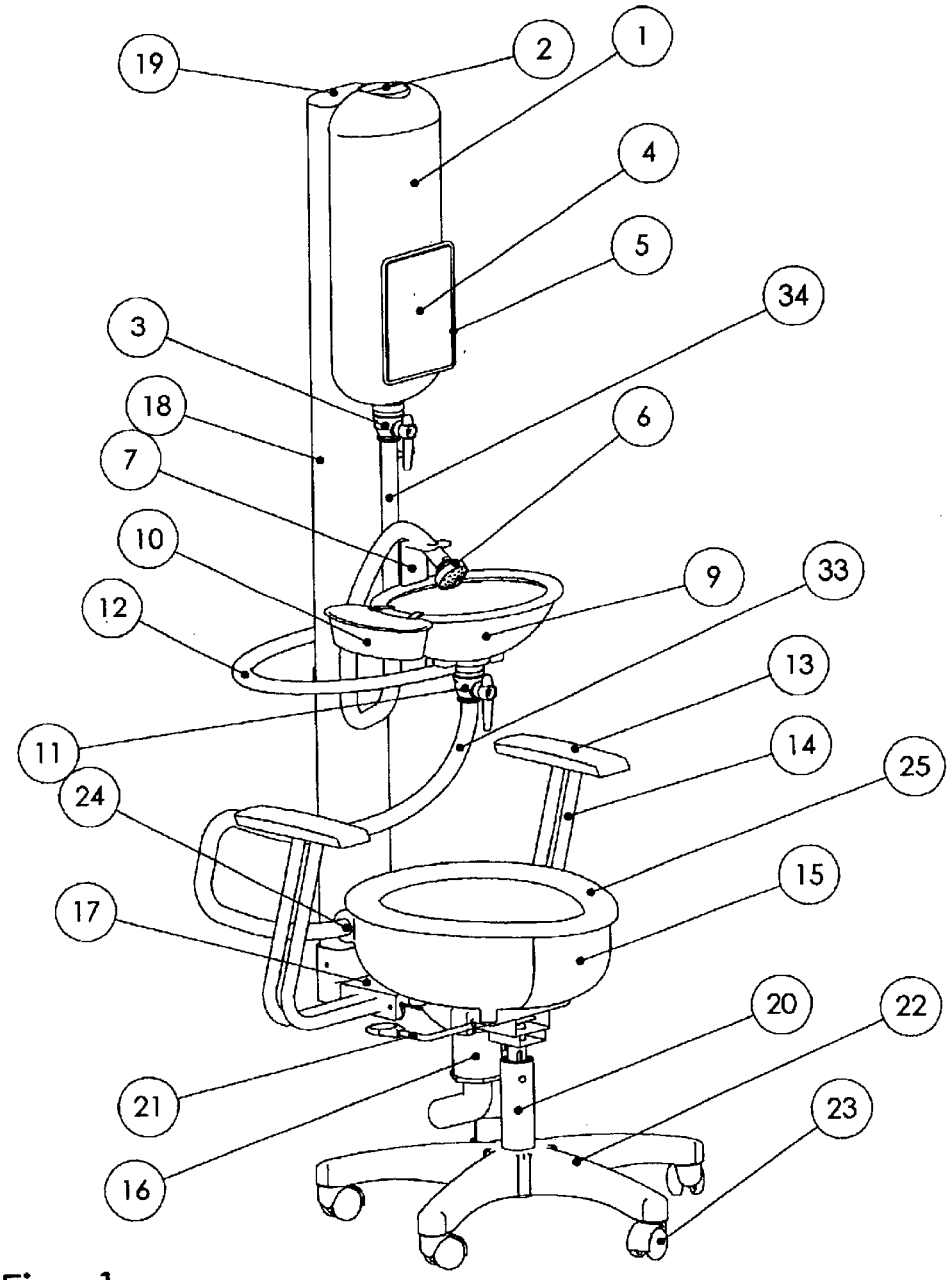
FIG. 1 depicts the device in its entirety from a left sided, three dimensional, isometric view.

The terminology used herein should be interpreted in its broadest reasonable manner, even though it is being utilized in conjunction with a detailed description of a certain specific preferred embodiment of the present invention. This is further emphasized below with respect to some particular terms used herein. Any terminology that the reader should interpret in any restricted manner will be overtly and specifically defined as such in this specification. The preferred embodiment of the present invention will now be described with reference to the accompanying drawings, wherein like reference characters designate like or similar parts throughout.

FIGS. 1–8 illustrate a mobile washing bowl apparatus. FIG. 1 shows the apparatus in its entirety from a left sided, three dimensional, isometric view. The apparatus includes, in main part, a washing bowl support plate 17, a vertical support riser 18, a washing bowl 15 (this is a specific term coined by the inventor—the washing bowl is in the shape of a traditional toilet seat, especially a toilet seat used in non-home uses, such as a boat. The inventor does not call it a toilet bowl, because the primary use of this apparatus is not to be used as a toilet, but rather as a washing and personal hygiene apparatus), arm rest supports 14, arm rests 13, a water tank 1, a sink bowl 9, a sink bowl support arm 12, a pneumatic height adjuster assembly 20, wheelbase 22, and wheel assembly parts 23.

Figure 2:
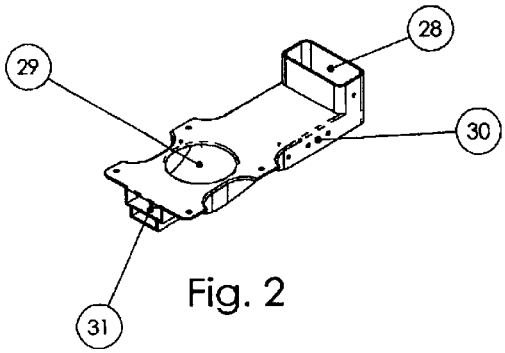
FIG. 2 depicts the washing bowl support plate, as this plate is the frame to which all other pieces ultimately attach.

The washing bowl support plate 17 is the main piece to which all other pieces ultimately attach. The washing bowl support plate 17 is preferably fabricated out of pressed steel with welded pieces, as it needs to be quite durable and strong in order to act as the backbone of the present apparatus. FIG. 2 shows the washing bowl support plate 17 as an unassembled piece. The vertical support receiver 28 accepts the vertical support riser 18 and is then bolted to the washing bowl support plate 17. Other pieces of the washing bowl support plate 17 are a washing bowl drain clearance port 29, arm rest support mounting surfaces 30, and the pneumatic height adjuster assembly holding blocks 31.

Figure 5:
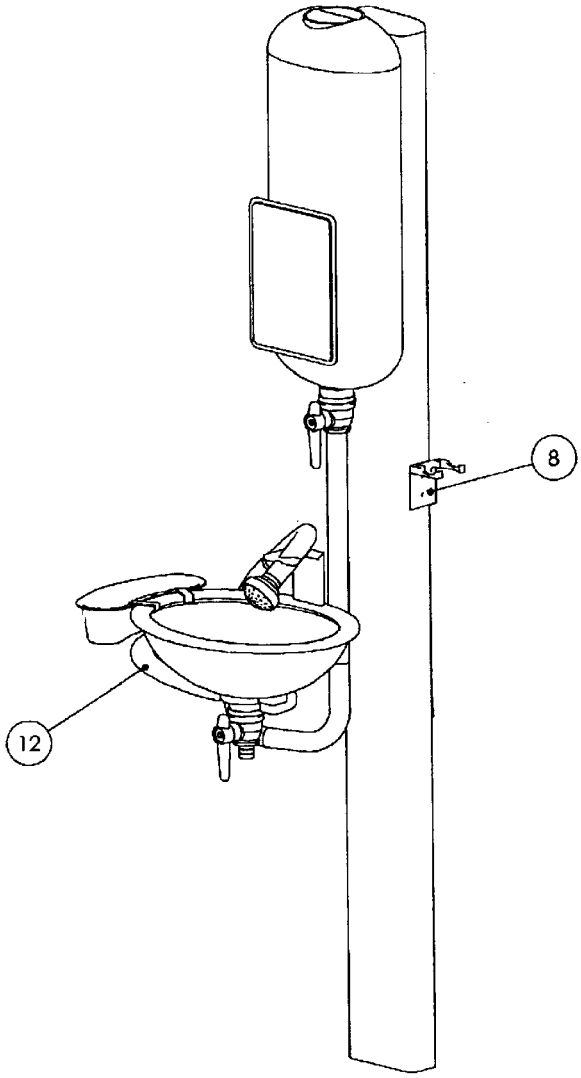
FIG. 5 depicts the upper assembly from a right sided, three dimensional isometric view. This upper assembly view depicts the sink, the sink bowl tray, the showerhead, the sink bowl showerhead holder, the vertical riser showerhead holder, the sink bowl support arm, the water tank, the water tank cap, the mirror, two 0.5-inch ball valve assemblies, two flexible hoses and the vertical support riser with riser cap.
Figure 7:
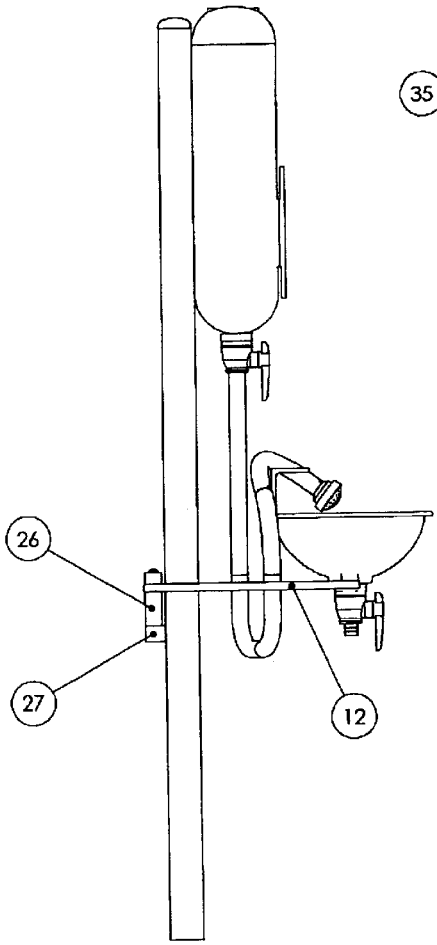
FIG. 7 depicts the upper assembly from a left sided, two-dimensional. In addition to the parts listed for FIG. 4, this upper assembly view depicts the hinged portion of the sink bowl support arm.

The vertical support riser 18 is preferably fabricated from any lightweight, yet durable material. The preferred embodiment is either moulded polyvinyl chloride (PVC) with a plurality of colored finishes, or from extruded aluminum that is then anodized. The vertical support riser 18 includes a showerhead hanger 8 as shown in FIG. 5, a vertical support riser cap 19, and a hinge post block 27, as shown in FIG. 7, that is either screwed or welded onto the vertical support riser 18.

Figure 3:
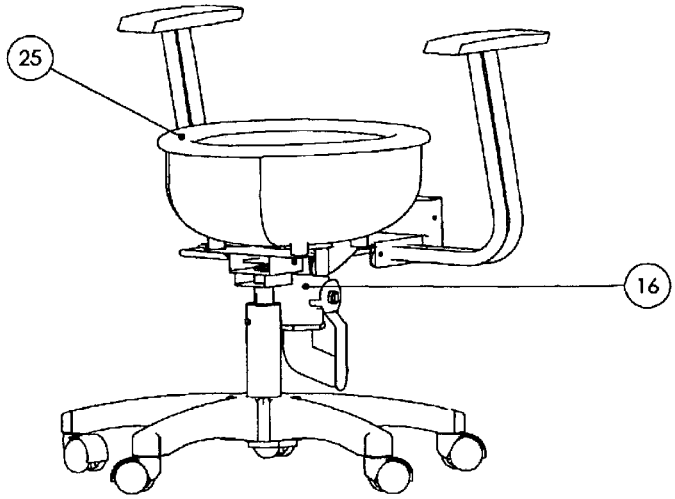
FIG. 3 depicts the lower assembly. This view of the lower assembly depicts the washing bowl, the washing bowl hygiene barrier, the 1.5-inch ball valve assembly, the caster base, the locking caster assembly parts, the pneumatic height adjuster lever, the arm rest supports, and the arm rests top and bottom plate.
Figure 4:
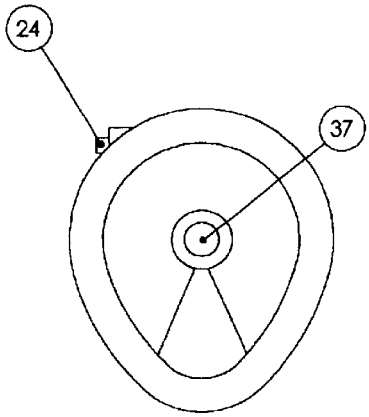
FIG. 4 depicts the washing bowl from a top view and shows the washing bowl drain.

The washing bowl 15 can be fabricated in a multitude of materials that are corrosion resistant, easily sanitized, and lightweight yet highly durable. The preferred embodiment is hydroformed stainless steel. The washing bowl 15 is formed in a basic toilet bowl oval shape. An optional washing bowl hygiene barrier 25 can be snapped onto the washing bowl 15 to cushion the user of this apparatus and also to act as a hygiene barrier. A washing bowl inlet 24, as shown in FIG. 4, is embedded in the side so that water can drain into the washing bowl 15 from the sink bowl 9. At the bottom of the washing bowl 15 is a washing bowl drain 37, as shown in FIG. 4. Affixed to the outside flange of the washing bowl drain 37 is some type of valve. The preferred embodiment of this valve is a one and one-half inch ball valve assembly 16, as shown in FIG. 3.

Armrest supports 14 attach to the washing bowl support plate 17, via the arm rest support mounting surfaces 30 as depicted in FIG. 2. The armrest supports 14 are terminated at the top with the actual armrests 13.

The pneumatic adjuster assembly 20 terminates at the wheelbase 22. The wheelbase 22 is preferably fabricated from a five legged star-shaped platform made from a highly durable moulded plastic for stability. Each of the five legs terminates in wheel assembly parts 23. Additionally, at the top of the pneumatic adjuster is a pneumatic height adjuster lever 21 to adjust the height of the washing bowl 15.

Figure 6:
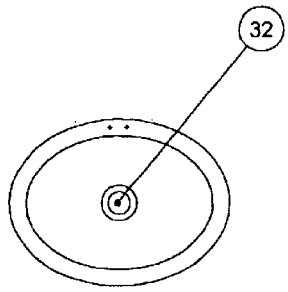
FIG. 6 depicts the sink bowl from a top view and shows the sink bowl drain.

The sink bowl 9 can also be fabricated in a multitude of materials that are corrosion resistant, easily sanitized, and lightweight yet highly durable. The preferred embodiment is hydroformed stainless steel. The sink bowl 9 is formed in a basic oval shape. A sink bowl showerhead holder 7 is attached to the rear of the sink bowl 9. The sink bowl showerhead holder enables the showerhead 6 to remain in a stationary and fixed position while in use. An optional sink bowl tray 10 can be snapped onto the sink bowl 9. The sink bowl 9 is affixed to the sink bowl support arm 12 as shown specifically in FIGS. 6 and 7. The sink bowl support arm 12 is preferably fabricated with steel or some other lightweight yet durable material. FIG. 6 shows the sink bowl drain 32 from a top view. The sink bowl support arm 12 is terminated with a sink bowl support arm hinge 26, as shown in FIG. 7. The sink bowl support arm hinge attaches to the hinge post block 27. On the outside of the sink bowl 9 and attached to the outside of the sink bowl drain 32 flange is a half-inch ball valve 11. Attached to the half-inch ball valve 11 is a flexible hose 33 which runs from the sink bowl 9 to the washing bowl inlet 24.

Figure 8:
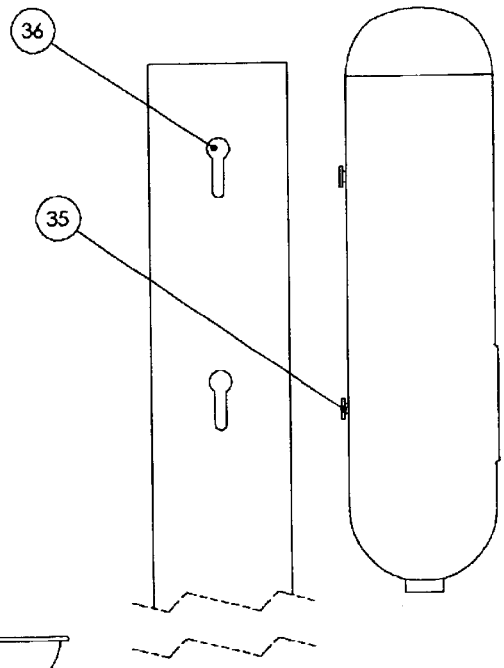
FIG. 8 depicts the water tank and its hanging tabs, as well as the vertical support riser and the accompanying hanging tab ports.

The water tank 1 is topped with a water tank cap 2. It is attached to the vertical support riser 18 by way of water tank hanging tabs 35 as shown in FIG. 8. The water tank hanging tabs 35 fit snugly into the vertical riser hanging tab ports 36. The water tank 1 terminates in a flange, and affixed to that flange is a water tank ball valve 3. A tank flexible hose 34 is terminated with a showerhead 6. The tank flexible hose 34 and accompanying showerhead 6 can be rested upon the sink bowl showerhead holder 7 or on the vertical riser showerhead hanger 8.

The foregoing description details certain preferred embodiments of the present invention and describes the best mode comtemplated. It will be appreciated, however, that no matter how detailed the foregoing description appears, the invention can be practiced in many ways without departing from the spirit of the invention. Therefore, description contained in this specification is to be considered exemplary, rather than limiting, and the true scope of the invention is only limited by the following claims and any equivalents thereof.

What is claimed is:

1. A mobile, portable, washing bowl and sink bowl device that employs water comprising:

a. a support structure including a vertical support riser and a washing bowl support plate;

b. a refillable fresh water tank attached to said vertical support riser in an upper portion;

c. a mirror attached to the front of the water tank;

d. a washing bowl attached to the washing bowl support plate with a drain pipe protrusion at the bottom of the bowl;

e. a sink bowl whereby the sink is bowl shaped with a cylindrical protrusion at the bottom;

f. a sink bowl support arm having one end attached to said sink bowl and an opposite end attached to said vertical support riser;

g. a wheelbase, with accompanying wheels having an upper portion, attached to the washing bowl support plate, wherein said upper portion of said wheelbase is a pneumatic height adjuster assembly having a pneumatic height adjuster lever for adjusting the height of said washing bowl, wherein the wheelbase is a five legged-star shaped platform, each of the wheels attached as a caster to the end of each of the wheelbase legs;

h. an upper flexible hose having a first end connected to said water tank and extending downwardly therefrom;

i. a lower flexible hose extending from the sink bowl to the washing bowl;

j. a showerhead holder affixed to said vertical support riser;

k. a showerhead affixed to a second opposite end of said upper flexible hose and supported above said sink bowl by said showerhead holder.

2. The upper flexible hose according to claim 1 wherein a. a shut off valve is affixed to the tank end of the upper flexible hose to enable or prevent the flow of water;

b. a coupling pipe affixes the upper flexible hose to the underside of the water tank.

3. The lower flexible hose according to claim 1 wherein a. the lower flexible hose affixes to the sink bowl by means of the cylindrical protrusion;

b. a faucet or shut off valve is embedded in the lower flexible hose at the top of the lower flexible hose to enable or disable the flow of water;

c. the lower flexible hose affixes to the washing bowl by means of a flange.

4. A water tank according to claim 1 wherein a. the water tank is made with a plurality of mechanisms with which to attach it to the vertical support riser.

5. A vertical support riser according to claim 1 wherein a. the vertical support riser has a plurality of mechanisms with which to receive and mount the water tank holder.

6. A washing bowl support plate according to claim 1 wherein a. arm rests supports are attached;

b. arm rest tops are attached.

7. A sink bowl according to claim 1 wherein a. an optional sink bowl tray can be attached.

8. A sink bowl according to claim 1 wherein a. a showerhead holder is affixed.

9. A sink support arm according to claim 1 wherein a. the sink bowl support arm terminates with a hinge to allow articulating movement of said sink bowl support arm and affixed sink bowl.

10. An arm rest support according to claim 1 wherein a. the arm rest supports can be adjusted.

* * * * *